United States Patent [19]

Klein

[11] Patent Number: 4,612,793

[45] Date of Patent: Sep. 23, 1986

[54] HYDROPNEUMATIC GUN FOR SETTING BLIND-RIVET NUTS

[75] Inventor: Günter Klein, Walldorf, Fed. Rep. of Germany

[73] Assignee: Gesipa Blindniettechnik Gesellschaft mit beschrankter Haftung, Frankfurt am Main, Fed. Rep. of Germany

[21] Appl. No.: 583,146

[22] Filed: Feb. 24, 1984

[30] Foreign Application Priority Data

Feb. 26, 1983 [DE] Fed. Rep. of Germany ..... 3306827

[51] Int. Cl.[4] ..... B21D 9/05

[52] U.S. Cl. ..... 72/311; 72/114; 72/453.17

[58] Field of Search ..... 72/114, 391, 453.17, 72/453.15, 453.19; 29/243.53

[56] References Cited

U.S. PATENT DOCUMENTS

| | | | |
|---|---|---|---|
| 2,583,733 | 1/1952 | Fischer et al. | 72/114 |
| 2,789,619 | 4/1957 | Wing et al. | 72/453.17 |
| 3,181,338 | 5/1965 | Zetterlund | 72/391 |
| 3,654,792 | 4/1972 | Mead | 72/114 |

FOREIGN PATENT DOCUMENTS

| | | | |
|---|---|---|---|
| 7208625 | 1/1974 | Fed. Rep. of Germany | 72/453.17 |
| 2320080 | 8/1981 | Fed. Rep. of Germany . | |

OTHER PUBLICATIONS

Gesipa, Pneum.-hydr. Nietwerkzeug GBM 70-May 1979.

*Primary Examiner*—Francis S. Husar
*Assistant Examiner*—David B. Jones
*Attorney, Agent, or Firm*—Karl F. Ross; Herbert Dubno

[57] ABSTRACT

A tool for setting blind rivet nuts has a housing having a head defining a head axis, a pulling rod extending along and rotatable about the head axis, projecting axially forwardly from the head, and threadable into a blind rivet nut, and a hydropneumatic actuator including a rear air chamber and a source of air under pressure for axially displacing the rod along the axis between an extended position projecting axially relatively far from the head and a withdrawn position axially therebehind. A pneumatic motor connected to the pulling rod for rotating same in one sense to screw it into a rivet nut and for rotating the rod in the opposite sense direction to screw it out of the nut. A manually operable valve is connected to the motor unit for rotating the rod in the one sense and an automatic valve independent of the manual valve unit is connected to the rod and between the rear chamber and the motor for feeding air from the air chamber to the motor unit and thereby automatically rotating the rod in the opposite sense on displacement of the rod by the hydropneumatic actuating unit from the extended to the withdrawn position.

17 Claims, 7 Drawing Figures

HYDROPNEUMATIC GUN FOR SETTING BLIND-RIVET NUTS

FIELD OF THE INVENTION

The present invention relates to the setting of blind-rivet nuts. More particularly this invention concerns a hydropneumatically powdered gun for setting such fasteners.

BACKGROUND OF THE INVENTION

A blind-rivet nut such as described in German patent document No. 7,208,625 is a tubular fastener formed internally adjacent its one end with a screwthread and formed externally at its opposite end with a radially projecting flange or rim. It is used to provide a screwthread in thin material, for instance sheet metal, and can simultaneously join together two such workpieces in standard rivet fashion.

Such a fastener is set by means of a tool such as described in German patent No. 2,320,080 of L. Elflein having a head from whose tip projects the threaded end of a pulling rod that extends along an axis and that can move axially and rotate about this axis relative to the head. The fastener is threaded onto the end of the rod until the flange engages against the tip, and then is inserted through a hole in the workpiece or workpieces so that the threaded nut end lies well past the back face of the workpiece and the flange lies flat against the front workpiece face. The pulling rod then withdraws backward, pulling the threaded end of the rivet nut towards its flange and upsetting the rivet to the other side of the workpiece, forming an annular rim that engages the back face of the workpiece. This firmly seats the rivet nut in the workpiece. The pulling rod is then screwed back out of the nut.

A fastener that is screwed to this fastener will be much more solidly mounted than, for instance, it would have been if it were merely held in place with a sheet-metal screw or were a screwthread cut in in thin sheet material. In addition this fastener makes it possible to remove and reinsert the screw in it many times, which would not be possible in sheet material. In addition this fastener makes it possible to remove the reinsert the screw in it many times, which would not be possible in sheet metal, and this fastener can simultaneously hold together two workpiece sheets or plates while providing a convenient threaded seat.

The tools for setting such blind-rivet nuts are unfortunately relatively inconvenient to use. It is necessary to be able to rotate the pulling rod in either direction, albeit with limited torque, to mount the fastener on it before setting it and to separate the tool from it once it has been set. In addition this rod must be able to move backward into the head with considerable force to upset the fastener. These styles of motion must be conveniently controlled by the operator, especially as such fasteners are most frequently used in large mass-production operations where one person will set literally thousands of such rivets in a day.

Above-cited German patent document No. 7,208,625 provides a small pneumatic motor for rotating the pulling rod and for upsetting the rivet nut. The force needed to upset the rivet is, however, considerable when the rivet nut is of steel, so that this tool is of only limited use, that is with relatively soft rivets. It has however been found that when the rivet nut is made of a material such as aluminum that is soft enough to upset easily, the screwthreads are equally weak and are often stripped from it during the upsetting operation, leaving in the workpiece a poorly set rivet nut that has no threads. Another disadvantage of this device is that converting it from one size of rivet to another necessitates replacement of the entire core of the tool, a complex operation that is inherently costly due to duplication of much of the tool structure for each different rivet size one needs to deal with.

The setting gun of German patent No. 2,320,080 has an undescribed actuator for axial displacement of the pulling rod, and a wheel rotationally coupled to the pulling rod that projects from the side of the housing. To mount a rivet nut on the pulling rod, the nut is fitted with one hand over the end of the rod while the user's other hand holds the tool and strokes the wheel against some object like a wall, to set the rod in rotation. This obviously takes quite some dexterity. Once the rivet is set the wheel is reverse rotated to unscrew the rod from it, a purely manual operation that is far from efficient and that once again requires some dexterity or the mandrel will jam in the set rivet.

The assignee of the instant application markets two hydropneumatic rivet-nut setting guns having a hydropneumatic actuator and handle that extend at close to a right angle to the setting head. Once the rivet is mounted on the pulling rod, a trigger is actuated to fill a large pneumatic compartment associated with a hydraulic piston that effects a force multiplication and applies it to the pulling rod. The pulling rod projects out of the back of the setting head and carries a knob so that it can be rotated freely by hand in either direction, or it can be rotated by a small turbine built right into the setting head. The turbine can rotate in either of two directions, respective buttons being provided to effect such rotation.

Such a tool unfortunately is fairly difficult to operate. The manual model actually requires three hands or great dexterity to mount a rivet nut on the pull rod, and the nonmanual one still requires the manipulation of three different controls to set a single rivet. Only a dextrous and mechanically gifted person can operate these tools smoothly.

Another tool is known from my copending patent application Ser. No. 363,288 filed Mar. 29, 1982, now U.S. Pat. No. 4,515,005. This riveter serves for setting standard blind rivets and has a housing forming an air chamber and a liquid-filled hydraulic chamber adjacent thereto, a head on the housing having a tip and forming a liquid-filled working chamber communicating with the hydraulic chamber, and a working piston in the working chamber and carrying a chuck for grasping a mandrel of a blind rivet. The head and chuck form a passage having a front end opening at the tip and a rear end opening into a mandrel-catching compartment and the piston is displaceable in the working chamber between a ready position in which a mandrel of a blind rivet can be fitted into the passage at the chuck with the rivet engaged backwardly against the tip and an actuated position spaced from the tip and wherein the chuck is retracted. An air piston is provided in the air chamber and carries a hydraulic piston displaceable in the hydraulic chamber between an advanced position pressurizing the hydraulic and working chambers and corresponding to a front position of the air piston and a retracted position corresponding to a rear position of the air piston. The air chamber is pressurized to pressurize the working chamber and displace the chuck from the ready to the actuated position. Thus on displacement of the chuck from the former to the latter position the mandrel is pulled off the rivet at the tip. A valve is connected between the air chamber and the passage for feeding air under pressure from the air chamber to the nozzle after displacement of the chuck from the ready into the actuated position and for thereby simultaneously sucking the pulled-off mandrel from the chuck back along the passage into the compartment.

This tool is very convenient to use, but not suited for the setting of rivet nuts.

OBJECTS OF THE INVENTION

It is therefore an object of the present invention to provide an improved gun for setting rivet nuts.

Another object is the provision of such a gun for setting rivet nuts which overcomes the above-given disadvantages, that is which is extremely easy to use and at least partially automatic, and that can readily be adapted for use with rivets of different sizes and materials.

A further object is to provide such a gun which operates hydropneumatically in a manner similar to that of my above-cited copending patent application.

SUMMARY OF THE INVENTION

A tool for setting blind rivet nuts according to the invention has a housing having a head defining a head axis, a pulling rod extending along and rotatable about the head axis, projecting axially forwardly from the head, and threadable into a blind rivet nut, and a hydropneumatic actuator including a rear air chamber and a source of air under pressure for axially displacing the rod along the axis between an extended position projecting axially relatively far from the head and a withdrawn position axially therebehind. A pneumatic motor connected to the pulling rod for rotating some in one sense to screw it into a rivet nut and for rotating the rod in the opposite sense direction to screw it out of the nut. A manually operable valve is connected to the motor means for rotating the rod in the one sense and an automatic valve independent of the manual valve means is connected to the rod and between the rear chamber and the motor for feeding air from the air chamber to the motor means and thereby automatically rotating the rod in the opposite sense on displacement of the rod by the hydropneumatic actuating means from the extended to the withdrawn position.

Thus with the system of this invention the screwing of the tip into the rivet nut is manually initiated, as is the action which upsets the rivet. The unscrewing action, however, is automatically induced at the end of the upsetting operation. Thus a rivet nut is aligned with and fitted to the threaded end of the rod, the manual valve is actuated to screw it up on this tip, and then the thus mounted rivet nut is fitted through a hole in a workpiece and another manual valve is tripped to upset it. Once the valve for the upsetting is released, the tool automatically screws itself out of the just-set rivet nut.

According to another feature of this invention the housing forms a liquid-filled hydraulic chamber adjacent the air chamber and the head forms a liquid-filled working chamber communicating with the hydraulic chamber. The hydropneumatic actuator has a working piston in the working chamber, carrying the rod, and displaceable in the working chamber between a ready position juxtaposed with the tip and corresponding to the extended position of the rod and an actuated position spaced therefrom and corresponding to the withdrawn position of the rod. An air piston is displaceable in the air chamber between a front position corresponding to maximum volume of the rear air chamber and a rear position corresponding to minimum volume of same and a hydraulic piston carried on the air piston is displaceable in the hydralic chamber between an advanced position pressurizing the hydraulic chamber and corresponding to the front position of the air piston and a retracted position corresponding to the rear position of the air piston. The air chamber can be pressurized by the source to move the air and hydraulic pistons into the respective front and advanced positions for pressurizing the working chamber and displacing the rod from the ready to the actuated position. Thus on displacement of the rod from the ready to the actuated position a rivet nut on the rod is upset.

The manual valve means of this invention includes a valve body normally projecting out of the housing, normally at the head thereof, and is provided with an actuating lever. This valve body can in fact project from a valve housing rotatable about the head axis on the head. Thus the valve body can be set in any position for convenient actuation either by bumping against the body of the person using it or an object nearby.

The housing according to this invention also forms a front air chamber also defined by the air piston and of minimum volume in the front position of the air piston and of maximum volume in the rear position of same. The hydropneumatic actuator includes a four-port two-position control valve connected to both air chambers, to the atmosphere, and to the source of air under pressure. This two-position control valve is movable between a position connecting the two air chambers together and a position connecting the rear air chamber to the source and the front air chamber to the atmosphere.

On the other hand, according to the invention, the manual valve includes a sleeve valve having one face exposed to the pressure of the source and an opposite and larger face exposed to a pressure that is either equal to or substantially lower than that of the source. More particularly, the manual valve includes a pilot valve manually actuatable to relieve the pressure at the larger face and having a coil spring in the housing and a button projecting from the housing and depressable thereon to block the turns of the spring. The pilot valve defines a flow path passing through the spring and interrupted when the button is depressed and the spring blocked.

The manual valve of this invention a three-port two-position valve connected to the source of air under pressure, to the motor, and to the atmosphere for alternately connecting the motor to the source or to the atmosphere. This manual valve can have one end face projecting from the housing and exposed to the atmosphere and another end inside the housing and exposed to the pressure of the source.

The automatic valve of this invention can be connected via the control valve to the air chambers and opens on displacement of the working piston from the actuated to the ready positions. In addition it includes a cutoff valve having a valve body fixed on the rod and a valve seat fixed in the housing. The automatic valve has a flow path passing from the front air chamber between the valve body and seat and thence to the motor means and the valve body engages the seat and blocks the flow path when the rod is generally out of the extended position. Thus only when the rod is extended and the front chamber is pressurized, can air flow along the path from the front chamber to the motor to reverse it in the other sense.

The tool of this invention also has an afterfill valve for connecting the front air chamber to the source of air under pressure when pressure in the front chamber exceeds a predetermined superatmospheric pressure. Thus the air flow from the front chamber to the motor to unscrew the rod is augmented. More particularly such an afterfill valve has a valve body having a relatively large face exposed to the pressure in the front chamber and an opposite relatively small face exposed to the pressure of the source and a valve seat against which the afterfill-valve body engages whenever pressure on the large face exceeds that on the small face by a predetermined factor determined by relative sizes, and from which it lifts whenever pressure on the large face drops below a predetermined level. The afterfill valve defines a flow path passing between the respective body and seat and extending between the source and the front chamber. Thus this flow path is cut off when pressure in the front chamber is below the predetermined pressure.

The hydropneumatic actuator of this invention has a pilot valve actuatable by a finger of the hand of a person holding the housing to move the rod from the withdrawn to the extended position. Similarly, the manual valve includes another pilot valve actuatable by the same finger of the hand of the person holding the housing to rotate the motor in the one sense. Thus the two simple control elements of the machine can be operated by the same finger of the same hand without changing grip on the machine. Operating them out of sequence will do no harm to the machine, although it might prematurely upset a rivet on the rod or spin off one just mounted thereon.

The rod according to the present invention has a threaded tip forming the threaded end and threadedly secured in the rod. The apparatus further comprises coupling means engageable between the rod and the tip to prevent relative rotation of same except when the tool is connected to the source. This coupling element is a noncircular-section pin axially displaceable in the rod and rotationally coupled thereto. The tip is formed with a complementary recess into which the pin is engageable. In addition the pin has a piston exposed to the pressure of the source when the tool is connected thereto and the coupling means includes a spring braced against the piston and urging the pin out of engagement in the recess. Thus the unscrewing action can be augmented, and when according to this invention the afterfill valve is adjustable the system can be set up to unscrew even from relatively large or long rivet nuts.

DESCRIPTION OF THE DRAWING

The above and other features and advantages will become more readily apparent from the following, reference being made to the accompanying drawing in which.

SPECIFIC DESCRIPTION

Figure 1:
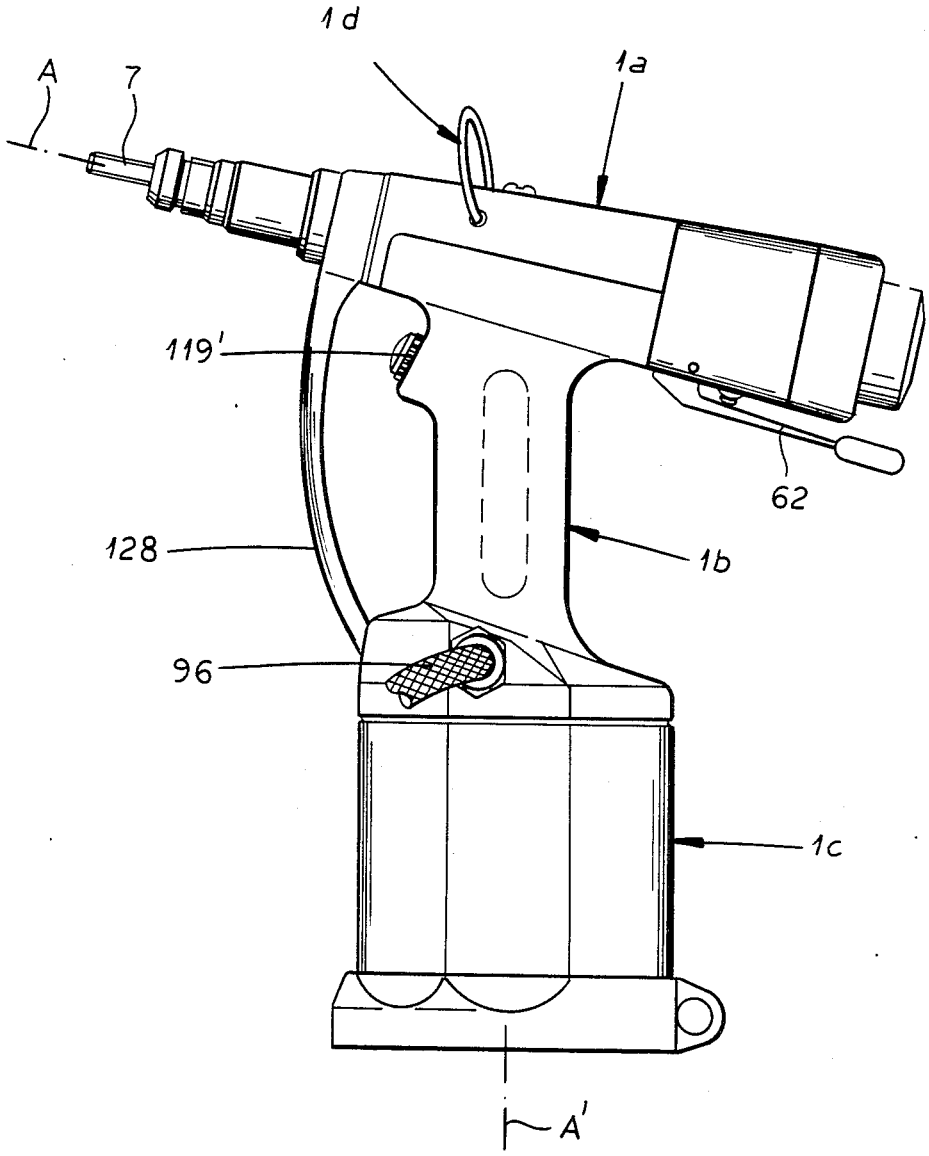
FIG. 1 is a side view of the riveter according to the invention.

As seen in FIG. 1 the riveter according to this invention basically is formed of a transverse riveting head 1*a* centered on an axis A, a handle 1*b*, and an actuator 1*c*, the latter two parts both being centered on an axis A′ intersecting the axis A at an angle of about 105°. This type of construction is standard and can be seen in the above-cited patents and patent application. The tool is shown sitting on its actuator 1*c*, the position it can safely be set down in. In addition it can be hung up from a loop 1*d*.

The head 1*a* has a tubular body 1 made of hard-coated aluminum and provided on its axially front end with an end piece 2 having a faceted neck 2′ so it can be screwed into and out of a sleeve 3 fitted in turn on a bayonet coupling 5 on the end of the body 1, its position being lockable by means of a locknut 6 for adjustment of the stroke L of the device. A tubular pulling tube 4 is axially displaceable inside the body 1 and a threaded pulling element or tip 7 is threaded into the front end of this pulling tube 4. This threaded element 7 and the end piece 2 are of the diameter and screwthread pitch of a rivet nut N (FIG. 2*a*) to be set. The threaded tip 7, endpiece 2, locknut 6, and sleeve 3 normally form a tip assembly that can be changed with another to accommodate all standard rivet-nut diameters from 3 mm to 12 mm.

A hexagonal-section drive rod 8 is axially displaceable in the tube 4 and engages through a guide 8′ fitted into the front end of the tube 4 into a complementary hexagonal blind bore in the rear end of the tip 7. Thus this rod 8 couples the tube 4 and tip 7 together for joint rotation in either direction, axial coupling being effected by the interfitting screwthreads of the tip 7 and tube 4. Rollers 9 received between races 10 and 11 on the sleeve 3 and tube 4, respectively, permit such rotation of the tube 4 and tip 7 in the head body 1 about the axis A. The coupling rod 8 is formed on its back end with a piston 48 and a helical compression spring 50 is braced between the front face of this piston 48, which is sealed by an O-ring 22 inside the tube 4, and the rear end of the coupling 8′. This spring 50 therefore urges the drive rod 8 into a position not engaged in the tip 7, in which position the tip 7 can be unscrewed. As will be described below, however, whenever the tool is hooked up to a supply of compressed air the piston 48 will be pushed down to couple together the tube 4 and tip 7 so that this tip 7 cannot rotate relative to the tube 4.

A tubular housing element 12 bears axially forwardly on a rim 13 on the front end of the body 1 and is provided with an external O-ring engaging the inner wall of the tubular body 1 and an inner O-ring engaging the outer surface of the tube 4. This element 12 therefore closes the front end of an annular compartment 20 surrounding the tube 4.

A pulling piston 15 sealed by a gland 17 in the body 1 is annular and fits around the tube 4, with a sleevelike forward projection 16 extending forward around the tube 4 and carrying an annular piston 18. This piston 15 normally bears axially forward against a housing ring 19 fixed in the body 1 and provided with a gland 23 surrounding the tube immediately in front of the pulling piston 15 and an outer O-ring engaging the head body 1. This ring 19 therefore defines with the piston 15 and the housing 1 an annular hydraulic compartment 75 connected via a bore 74 to a small-diameter hydraulic chamber 69 centered on the axis A' in the handle 1*b*. The tube 4 is received with play 14 in the piston 15 and its extension 16. A screw 76 having a washed 77 is threaded through the body 1 at the chamber 75 to allow the hydraulic fluid in it to be drained or changed.

Another tubular element 25 is fixed in the body 1 immediately in front of the ring 19 and is sealed against the extension 16. This element 25 has a thin-wall forward extension 24 whose inside diameter is the same as the outside diameter of the annular piston 18 fixed on the extension 16. Thus on axial backward displacement of the piston 15 relative to the housing 1, this piston 18 slides up within this extension 24, cutting the compartment 20 off from the interior of the element 25. A hole 26 opens radially outward from the back upper end of this extension 24 and communicates with a passage 116 extending back through the handle 1*b*. Thus the element 25 and piston 18 effectively form a valve which is in the flow path between the compartment 20, which itself communicates with the play 14, and the passage 116, which valve closes when the piston 15 moves back inside the head body 1.

The tube 4 is provided internally about level with the piston 15 with a tubular reinforcement plug 49 and is provided externally just above the piston 15 with an entrainment ring 27 held in place on itself by a snap ring and movable in an annular chamber 31 defined within another annular cup-shaped piston 28 sealed via O-rings 29 and 30 respectively against the body 1 and tube 4. The compartments 31 and 20 communicate through the play 14 between the tube 4 and piston 15 and its extension 16. This piston 28 serves a return function and defines on its axial back face a chamber 73 through which extends a tube 51 fixed in the piston 28 and opening at one end into the chamber 31 and at its other end into a passage formed in a motor housing 32 threaded into the rear end of the body 1. Thus the interior of this tube 51 communicates directly with the compartment 20 through the compartment 31 and the play 14.

A low-torque pneumatic motor 36–39 in the housing 32 has a rotor 37 formed with vanes 42 and drives a planetary-gear transmission 44–47 by means of an output shaft 44 formed as a sun gear meshing with planet gears 45 meshing with a ring gear 53 fixed in the motor housing 32. A rotatable carrier 46 for the gears 45 in turn has a hexagonal-section output shaft 47 fitted into the complementarily shaped rear end of the tube 4. The motor housing 32 has a front bearing plate 36 connected via a tubular extension 38 to a rear bearing plate 39 on which the rotor 37 is supported for rotation about the axis A. The front bearing plate 36 is formed with two sets each of one or more angled ports, and when the one set is pressurized the rotor 37 turns about the axis A in one direction and when the other is pressurized the rotor 37 turns in the opposite direction. The shaft 47 is sealed in the motor housing 32 so as to close off the back end of the chamber 73 and fits with slight play inside the tube 4 so that this chamber 73 commnicates through this tube 4 and its plug 49 to a chamber defined between this plug 49 and the piston 48 on the coupling rod 8.

A valve housing 33 is rotatable about the axis A on the motor housing 32 and has a front end sealed thereon by an O-ring 34 and carries on its rear end a sound-deadening shield 40 secured in place by a cap 41 screwed over the rear end of the motor housing 32. This motor housing 32 is received with play 52 within the housing 33 and is formed with passages 60 and 61 communicating between the annular space defined by this play 52 and the chamber 73 defined in back of the return piston 28. Facing grooves 52' in the tubular elements 32 and 33 receive a valve element 55 engaging through a radial hole or seat 54 in the housing 33. The play 52 is sealed axially behind these grooves 52' by an O-ring 35. An axial passage 56 extends in the housing 33 from the hole 55 to a radial bore 57 communicating with a radial bore 58 in the housing 32 that in turn opens into an angled input port 59 directed as described above at the rotor 37 so that when air issues from it it will rotate in one direction. This direction is that one which is effective through the transmission 44–47 to rotate the tip 7 to screw it into an internally threaded blind-rivet nut, as will be described below. A lever 62 pivoted about an axis perpendicular to the plane of the axes A and A' can push the valve body 55 from the illustrated position in which it blocks flow out of the grooves 52' and vents the motor chamber to the atmosphere, to a position in which it feeds air from the grooves 52' to the port 59 to pneumatically power the motor.

The handle 1*b* is formed by a tubular extension 63 formed unitarily with the body 1 and forming the hydraulic chamber 69 and a surrounding sleeve 70 that is flanged out at the body 1 and that forms an annular passage 64 and the passage 116. A gasket 71 is provided at the joint between the body 1 and the handle 16, and a passage 72 communicates between the annular passage 64 and the compartment 73.

Figure 2A:
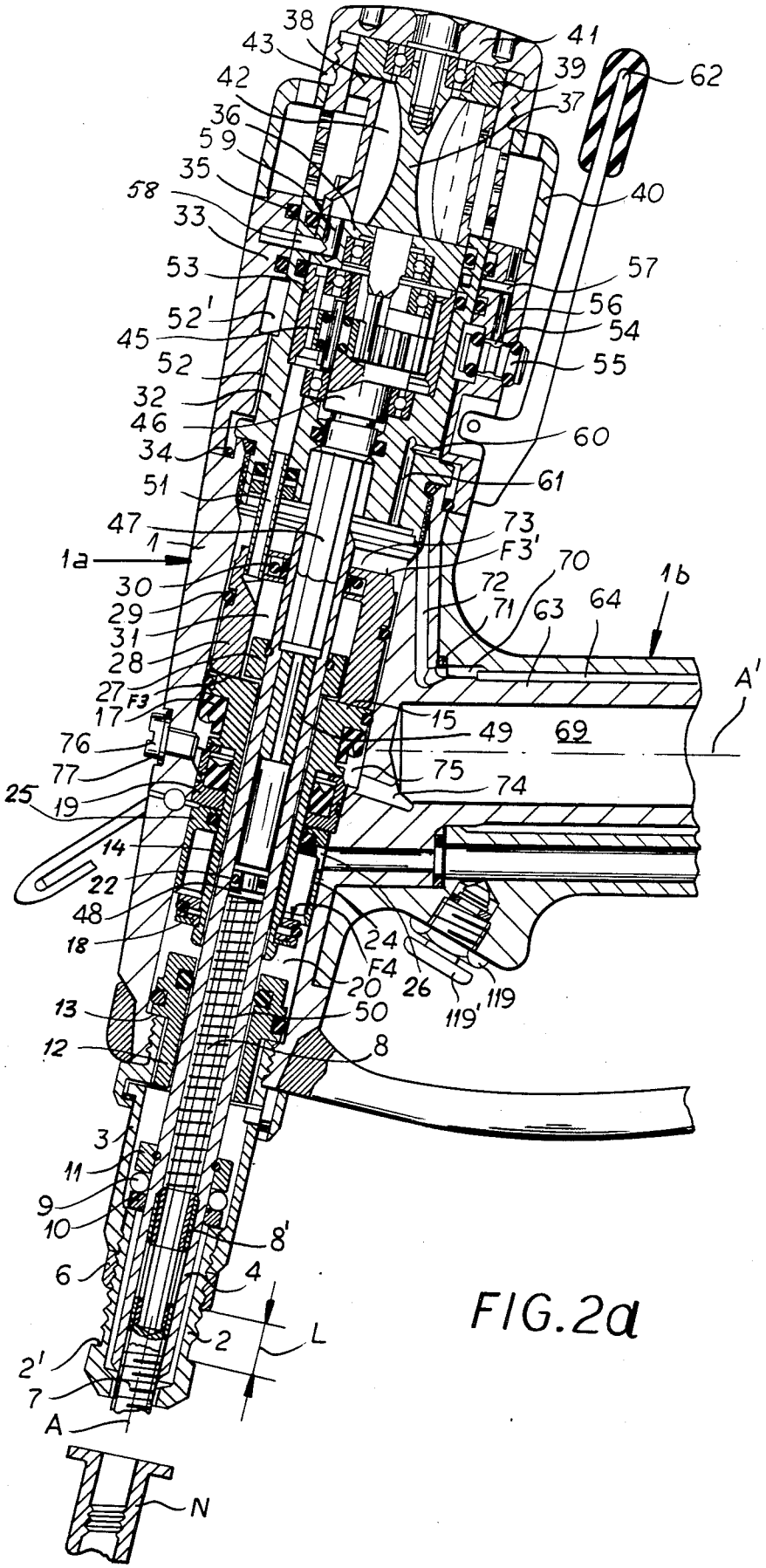
FIGS. 2*a* and 2*b* are axial sections respectively through the front and rear halves of the riveter.
Figure 2B:
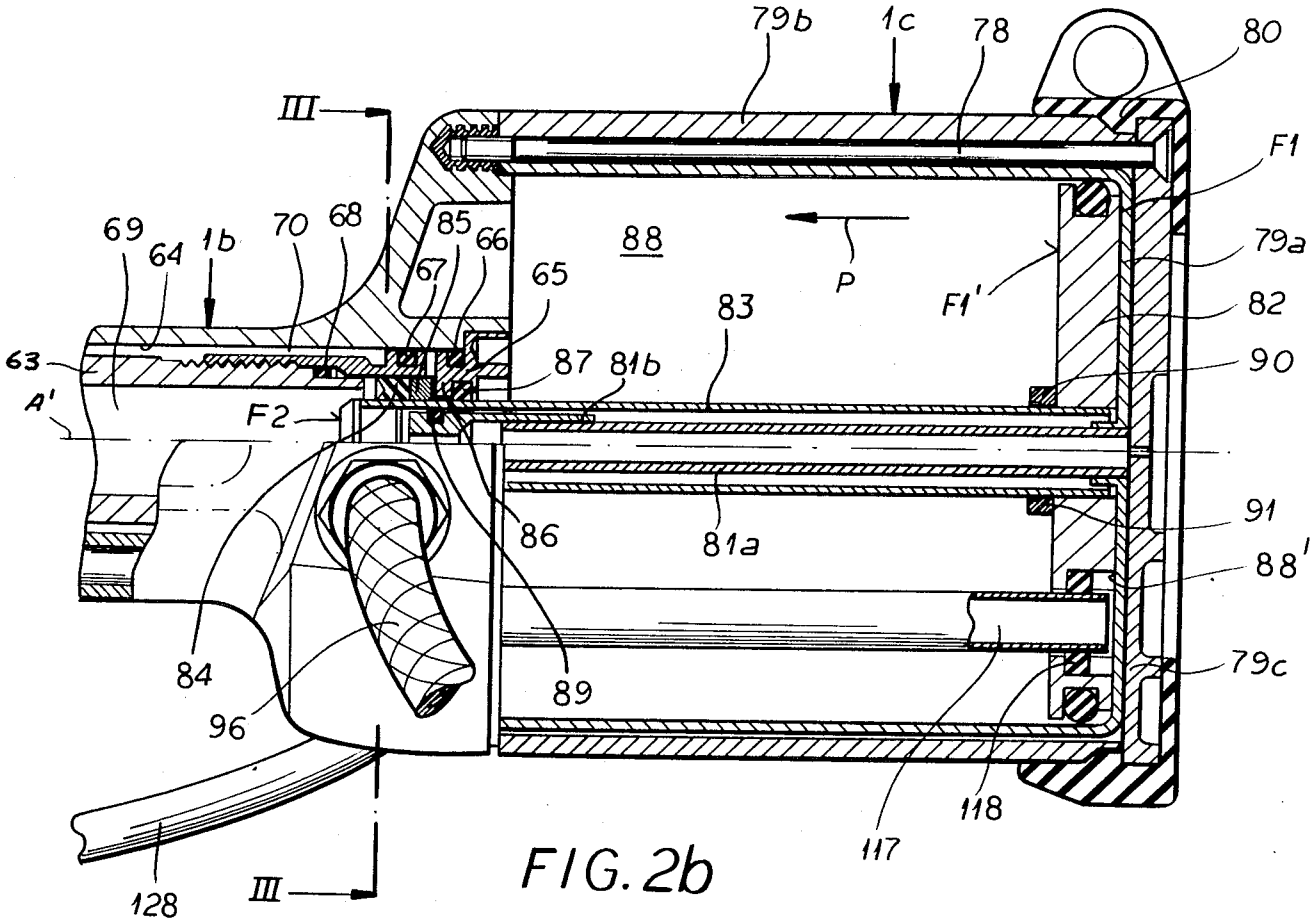

As seen in FIG. 2*b* the extension 63 is clamped against the head 1*a* by a locking ring 65 sealed with respect to the sleeve 70 by O-rings 66 and 67 and against the extension 63 by a ring 68. The extension 63 forms the central cylindrical bore or hydraulic chamber 69 centered on the axis A' and connected at its front end through the passage 75 and the hole 26 to the interior of the part 25.

The rear end of the handle part 70 is formed with a flange that is secured by eight angularly equispaced long screws 78 to a synthetic-resin cylinder-forming cup 79*a*, 79*b* of the actuator 1*c*. These screws 78 also secure a metal disk or end plate 79*c* over the base of the cup 79*a*, 79*b*. An annular rubber cover or rim cap 80 is snap-fitted over the rear end of the actuator 1*c* and allows the device to be stood on its rear end as shown in FIG. 1, with the axis A' vertical, without marring that which it is sitting on. A tubular equalizing piston 81*a*, 81*b* extending along the axis A' is secured at its rear end to the base of the cup 79*a*, 79*b* and to the plate 79*c*. To this end, the cup 79*a*, has the thin liner 79*a* formed with a central hole that is bent in and welded to the rear end of the equalizer piston 81*a*, 81*b* which itself has a thin-walled rear portion of 81*a* secured to the liner 79*a* and the more massive front end 81*b*.

An annular pneumatic piston 82 is axially displaceable in the cup 79*a*, 79*b* and has an O-ring that seals it externally against the inner wall of this cup 79*a*, 79*b* to form large-diameter front and rear pneumatic chambers 88 and 88' in the cup 79*a*, 79*b*. The inner diameter of the piston 82 is greater than the outer diameter of the equalizer piston 81*a*, 81*b*. A tubular hydraulic piston 83 coaxially but spacedly surrounds the equalizer piston 81*a*, 81*b* and has a closed front end slidable in the chamber 69. This chamber 69 is sealed by a piston seal 84 between the ring 65 and the piston 83 from the front pneumatic chamber 88 and is sealed by the seal ring 68 from the passage 64 between the projection 63 and handle part 70. A guide ring 85 for the piston 83 is provided between the seal 84 and a radially inwardly extending projection 86 of the ring 65. The side of the projection 86 turned toward the chamber 88 carries another seal ring 87 which also seals off the chamber 88. The thick front part 81*b* corresponds almost to the inner diameter of the tubular piston 83 and is provided with a seal ring 89 that wipes the inner wall of this piston 83. The rear end of this piston 83 is provided with a bumper ring 90 held in place by a snap ring 91.

This chamber 69 defined by the extension 63 and the piston 83 and seal 84 sealing its rear end, as well as the passage 74 and the chamber 75 are completely filled with hydraulic fluid, which can be changed or added to via the hole blocked by the screw 76 as mentioned above.

Figure 3:
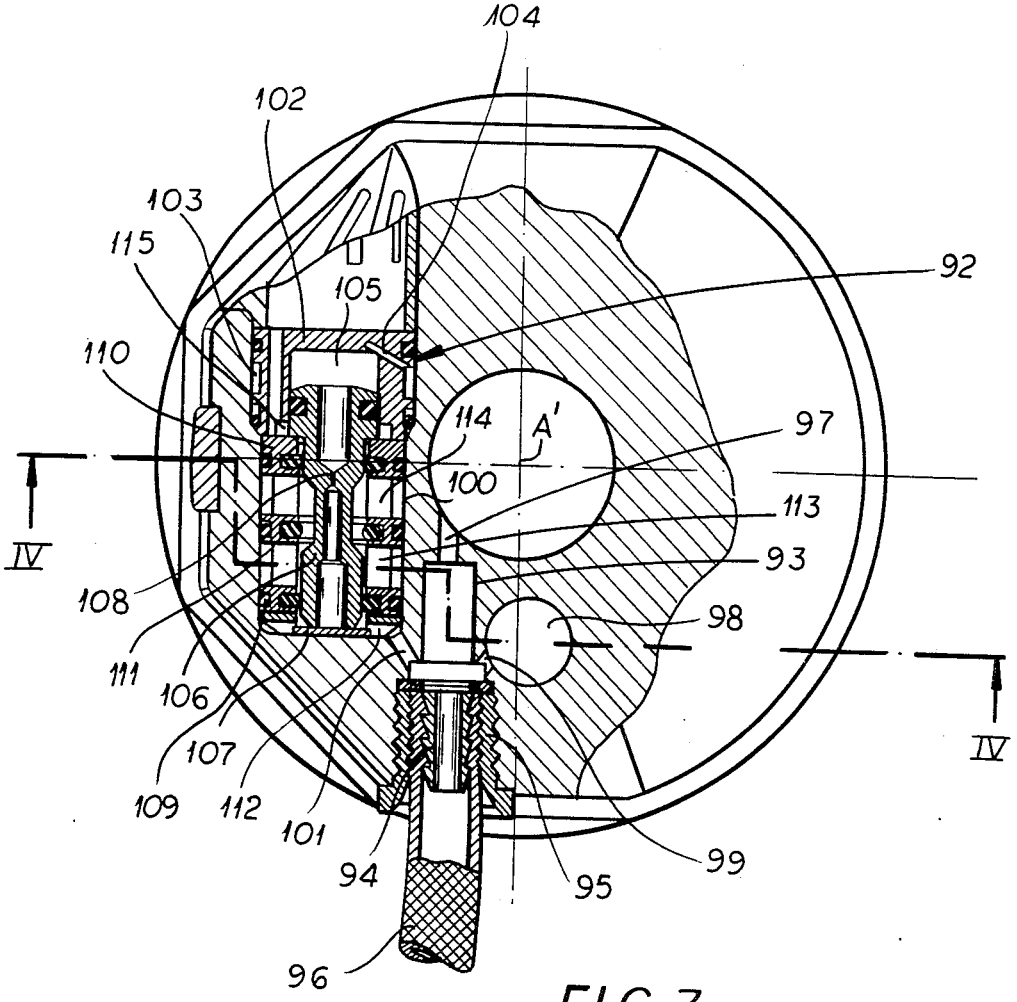
FIG. 3 is a large-scale section taken along line III—III of FIG. 2*b;*

The riveter control arrangement shown in FIG. 3 is mainly mounted in a thickened lower region of the handle part 70. It has a pneumatically operated four-port two-position air valve 92 having a tubular valve element or spool 106 that is stepped between one end region of relatively large diameter, an opposite end of intermediate diameter, and two central regions of small and intermediate diameter, respectively, with the small-diameter region lying between the two intermediate-diameter regions. It is received in a bore 100 closed at one end by a cup-shaped cylinder 102 formed with an external annular groove 103 communicating via one or more passages 104 with a chamber 105 within the cup 102 and formed internally with a radially inwardly open groove 115. This cylinder 102 secures three rings 110, 111, and 109 in place, defining altogether five separate chambers 105, 115, 114, 113, and 112. Centrally the spool 106 is formed with a restriction pore 108 permitting limited flow between the chambers 105 and 112.

The chamber 112 is provided with a bumper washer 107 for the valve body 106 and is permanently connected via a passage 101 to a high-pressure air hose 96 connected to the housing by a nipple 94 and sleeve 95. Thus the highest pneumatic pressure in the system will always be effective against the intermediate-area surface of the spool 106 exposed in this chamber 112. The opposite chamber 105 is connected via the restriction 108 to the chamber 112 and can be vented via a valve 119 to the atmosphere. This valve 119 is has a pushbutton 119' and is provided at the front end of the handle 1*b* within the hand-protecting guard 128 thereof. The compartment 113 is connected via a sleeve 117 passing through a seal 118 in the piston 82 to the rear air chamber 88'. The compartment 114 is connected to the front chamber 88 and via the passage 116 to the interior of the element 25.

FIG. 3 also shows how the air-supply hose 96 is connected via a passage 97 to the annular passage 64 so that this passage as well as the chamber 73 are always interconnected and, therefore, under the same pressure. In addition the hose 96 is connected via a short branch passage 99 to the base of an axially extending blind bore 98 opening into the compartment 88 and holding an afterfill valve 120 which is described below.

This arrangement described above functions as follows:

Until the tool is connected via the hose 96 to a supply of air under pressure it is normally in the position shown in FIGS. 2*a* and 2*b*, except that the piston 48 is not pressed down to compress the spring 50 and the rod 8 therefore also does not couple the tube 4 and tip 7 to prevent the tip 7 from rotating in the tube 4. In this position the tip 7 can be changed.

When pressure is applied the position of FIGS. 2*a* and 2*b* will be assumed. The hose is connected via the passage 97 to the passage 64 and thence via the passage 72 to the chamber 73. This forces the return piston 28 axially forward and pushes the hydraulic piston 15 down also if it is not already down. As a result the volume of the chamber 75 is minimized and fluid is forced from it through the passage 74 into the chamber 69 to push the pistons 82 and 83 back into the FIG. 2*b* position. The coupling piston 48 and rod 8 will be pushed down to rotationally lock the tube 4 and tip 7 together. In addition the two chambers 88 and 88' are connected together through the valve 92 and the pressure in the chamber 73 is applied through the passages 60 and 61 and the play 52 to the chamber/groove 52' to push the valve body 55 out against its seat 54 and close off any flow along this route. No pressure can be held in either or the chambers 88 or 88' as they are connected together and to the passage 116 which is vented via the chamber 20, the play 14, the chamber 31, and the tube 51 through the transmission 44–47 to the motor 36–39 and thence to the atmosphere.

To fit a blind-rivet nut N to the tip 7, the nut N is aligned with and pressed against the tip 7, for instance with the nut N held in the left hand and the handle 1*b* in the right hand although of course the tool can be used with equal ease by a left-handed person. The lever 62 is then bumped, opening the valve 55 to feed the pressure from the chamber 73 through the passages 60, 61 the play 52, the grooves 52', and the passages 56–58 to the rotor 37 in a direction to rotate the tip 7 in the direction causing it to screw itself into the nut N. The lever 62 can be actuated by the arm or chest of the user with ease, and the ability of turning the valve housing 33 around to orient the lever 62 in any angular position around the axis A makes it possible to effect this operation by bumping the lever 62 against any handy object, while still holding the tool securely. Since the torque of the pneumatic motor is very smallm once the nut N engages the end piece 2 the motor 36–39 will stop turning, without deformation of the nut N.

The thus mounted rivet nut N is then fitted through the hole in the workpiece or workpieces. Then the button 119' is pressed so that the chamber 105 loses pressure and the valve body 106 moves up as seen in FIG. 3. This action connects the high-pressure compartment 112 to the compartment 113 and thence to the rear pneumatic chamber 88', and vents the front pneumatic chamber 88 to the atmosphere by interconnecting the compartments 114 and 115. Such pressurization of the large-diameter rear chamber 88' exerts a large force in a forward pulling direction P on this piston 82, one that can be several tons using pressurized air from a standard heavy-duty compressor. The pistons 82 and 83 therefore move forward in this direction P, which will force hydraulic fluid under considerable pressure from the chamber 69 through the passage 74 into the chamber 75 to exert a considerable axially backwardly effective force on the pistons 15 and 28. As the piston 83 moves in the direction P, pressure inside it will be equalized through the tubular equalizer piston 81*a*, 81*b* whose interior is permanently vented to the atmosphere. The result will be to upset the rivet nut N screwed onto the tip 7, with a force easily sufficient for stainless steel or similarly hard rivet nuts. A sure and solid setting of the rivet nut is assured.

The surface area F1 of the rear face of the piston 82 is much larger than the surface area F3' of the rear face of the piston 28 so that, even though the same pneumatic pressure is bearing on both of them, the force effective away from the tip 7 is substantially greater than the opposite force, so that the piston 28 will move back.

During such upsetting of the rivet the space inside the element 25 remains under the same low pressure as the vented front compartment 88 and this space is closed off axially forwardly by the ring piston 18. The compartment 20 is therefore not pressurized, along with the compartment 31 that communicates via the play 14 with it and via the tube 51 with the other actuating port of the pneumatic motor 36–39.

Release of the button 119' allows the pressure in the two valve compartments 105 and 112 to equalize, returning the valve to the FIG. 3 position, cutting the front chamber 88 off from the atmosphere, and connecting it to the rear chamber 88'. Thus the above-described relationships are largely reversed. The chamber 73, however, will continue to be pressurized, so it will force the return piston 28 forward, frictionally entraining the tube 4 and tip 7 and axially pushing the hydraulic piston 15 forward. Thus as the pressure in the chamber 73 moves the tube 4 forward it forces hydraulic fluid out of the chamber 75 into the compartment 69, driving the pistons 83 and 82 back with considerable force.

Furthermore, since at the moment of switchover of the valve 92 the chamber 88' is pressurized, a considerable volume of air is therefore forced out of this chamber 88' and passes via the compartment 113 to the compartment 114 and thence via the passage to the interior of the element 25 and to the front compartment 88. As soon as the forward advance of the piston 15 is sufficient to pull the ring piston 18 out of the element 25, this pressure can pass via the play 14 between the tube 4 and piston 15 to the chamber 31 and thence via the tube 51 to the port of the motor that reverse drives it, causing it to rotate the tip 7 in a direction unscrewing it from the rivet nut N it has just set. Such unscrewing therefore is wholly automatic, occurring at the end of each rivet-setting operation. It is in fact effected by the compressed air that otherwise would normally be released from the tool, representing a useful saving of energy.

Figure 4:
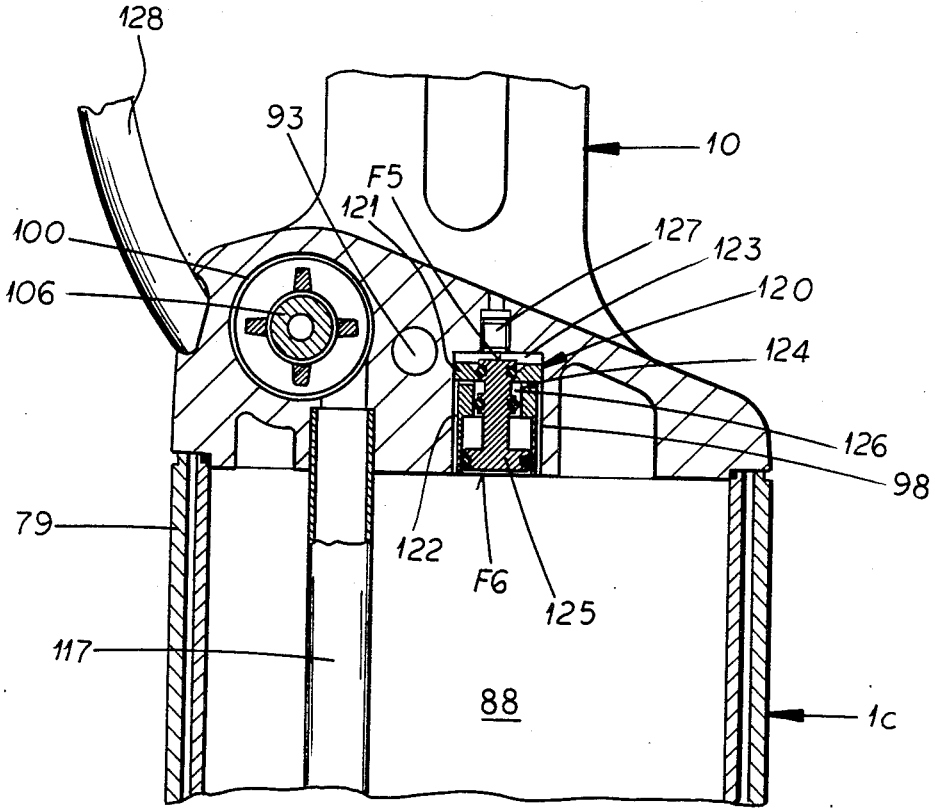
FIG. 4 is a large-scale section taken along line IV—IV of FIG. 3.

As the air pressure inside the chamber 88' might be insufficient to completely unscrew the tip 7 from the rivet nut N, this invention is provided with an afterfill valve 120 shown in FIG. 4, mounted in the front part of the actuator 1*c*. This valve 120 is carried in the bore 98 which opens into the front pneumatic chamber 88 and which, as mentioned above, is continuously pressurized at its end away from the chamber 88 by connection to the hose 96. The chamber 88 itself is pressurized by connection through the valve compartments 113 and 114 to the chamber 88' during the return stroke of the piston 82.

The valve comprises a cup 121 having a rear end completely filling and blocking the bore 98 and a front end separated by a space 122 from the wall of the bore 98. A piston 125 has an end of large diameter F6 exposed in the chamber 88 and an end of small diameter F5 exposed in the pressurized blind end 123 of the bore 98. An intermediate chamber 126 opens via small passages or bores 124 into the space 122 and thence into the chamber 88 and can open when the piston 125 is moved axially forward, that is up in FIG. 4, into the compartment 123. A screw 127 operable from outside the tool can set the rest position of the piston 125 and thereby control the flow through it. The valve 120 is therefore nothing more than a two-port two-position valve which responds to pressure by connecting the source line 96 to the chamber 88 when pressure in this chamber 88 exceeds a certain level, for instance 6bar, which only occurs during the return stroke in direction P of the piston 82.

Thus, during the working stroke of the tool the pressure in the chamber 88 will be very low, as the valve 92 will be venting it to the atmosphere, so that the valve 120 will be closed. During the return stroke, however, when the pressure is higher, the pressure against the face F6 will be sufficient to overcome the higher pressure against the smaller face F5 and will push the piston 125 against the screw 127 and allow this high pressure into the chamber 88. The result is increased pressure to unscrew the tip 7 from the rivet, increased by an extent adjustable via the screw 127.

The above-described sequence of operations is possible due to the dimensioning of the various pistons 18, 28, 82, and 83 and works in a manner similar to that described in the above-cited copending patent application. The effective surface area F1 of the rear face of the piston 82 is slightly greater than the area F1' of its front face, largely equalized by use of the guide piston 81*a*, 81*b*. The piston 83 has a surface area F2, and the pistons 15, 28 have a front-face area F3 and the rear-face area F3'. The rear face of the piston 18 has an area F4. All these piston faces are planar, and all but the face of area F2 are annular.

During the pull stroke the force effective on the puller 4 will be equal to:

$$(F1 \cdot F3)/F3' \cdot \text{pressure-friction}.$$

During return the pneumatic force is equal to $$(F3' + F4) \cdot \text{pressure}.$$

This force is effective through the hydraulic fluid on the piston 83, moving it with a force equal to:

$$[(F3' + F4) \cdot F2] \cdot \text{pressure}/F3,$$

which force is greater than the opposite force which is equal to:

$$(F1 - F1') \cdot \text{pressure}.$$

so the net force is:

$$[(F3' + F4) \cdot F2/F3] - (F1 - F1')] \cdot \text{pressure-friction}.$$

Clearly, even though the chamber 73 remains pressurized, the machine can carry out this return stroke.

Figure 5:
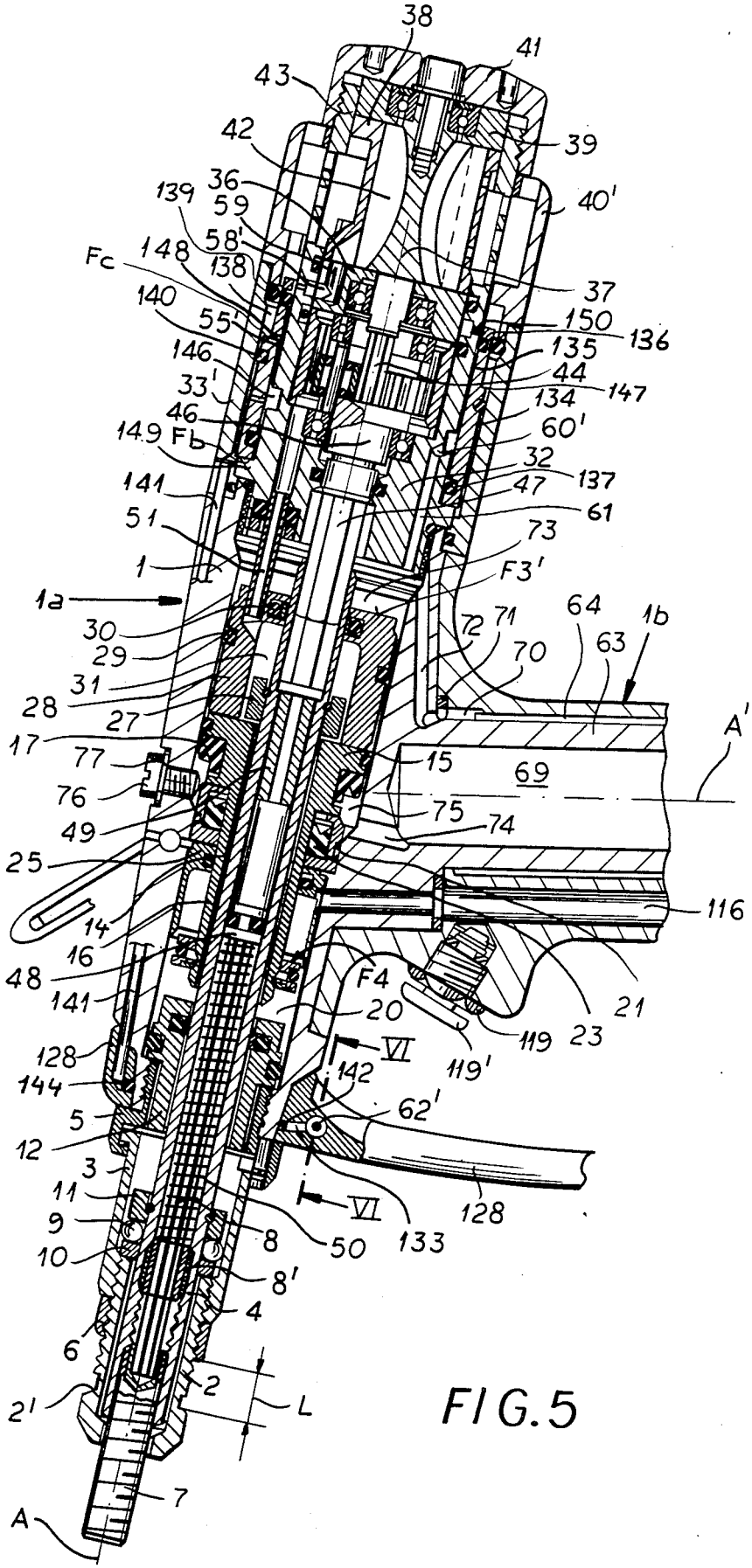
FIG. 5 is a section like FIG. 2*a* but of another riveter according to the invention.
Figure 6:
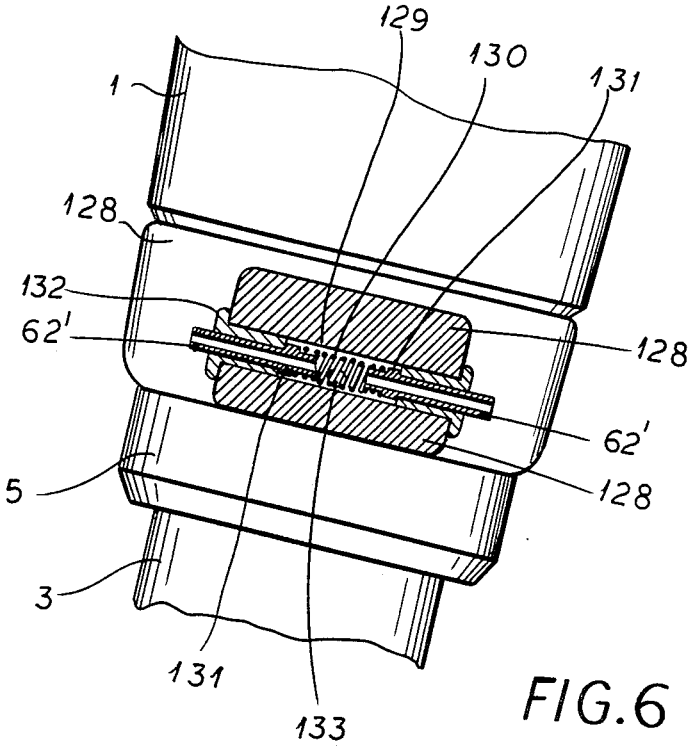
FIG. 6 is a large-scale section taken along line VI—VI of FIG. 5.

The arrangement of FIGS. 5 and 6 is substantially identical to that of FIGS. 1 through 4 and identical reference numerals have been used for identical structure. The main difference is in how the initial screwing of the tip 7 into the rivet nut is done.

As seen in FIG. 6 the hand-protecting guard 128 is formed with a crosswise transverse bore 129 fitted with two sleeves 132 in each of which is slidable a tube 62' having a ridge 131. A helical compression spring 130 is braced between the two ridges 131 and urges the tubes 62' apart. Depression of either of these tubes 62' toward the other will cause the turns of the spring 130 to abut, effectively forming the spring 130 into a laterally closed tube. A passage 133 opens into the bore 128 between the inner ends of the two pilot-valve tubes 62'.

FIG. 5 shows how the passage 133 of the hand guard 128 connects to an annular groove 142 that is inwardly closed by a seal 144 and that is connected to one end of a tube 141 extending up into a region 134 of play outwardly defined by a valve body 33' that is not rotatable on the body 1, as in the embodiment of FIGS. 1 through 3.

In this arrangement the body 32 is formed with bores 61 and 60' that lead from the chamber 73 and open into a groove or chamber 146 that in turn opens into a space or play 135 between a valve sleeve 55' and the motor body 32. This space 135 is axially closed at both ends by O-rings 136 and 137 seated in the cylindrical inner surface of the sleeve 55' and riding against the motor body 32. The sleeve 55' has an outer surface having a central axially backwardly directed step or shoulder 147. Immediately below this shoulder 147 the sleeve 55' carries an O-ring 140 riding on the inner surface of the valve housing 33' and below this O-ring 140 the sleeve is formed with at least one radially throughgoing bore or passages 145 opening into the region 135 or play. Thus a flow path is defined from the normally pressurized chamber 73 through the bores 61 and 60', the groove 146, the holes 145, the play 134, the tube 141, groove 142, the passage 133, and into the bore 129 and thence between the turns of the spring 130 and out the tubes 62'. As will be described below, pushing in either of the tubes 62' will interrupt this path, valve-fashion, by closing the turns of the spring 130 together and incidentally normally blocking off at least one of the tubes 62'.

The housing 32 in turn is formed at its upper end with radially throughgoing holes or passages 150 that open in the motor housing at passages 58' that communicate with the reverse-drive ports 59. Between the seals 137 and 140 the sleeve 55' is formed with radially throughgoing holes 148 opening into an otherwise closed annular chamber 138 whose one end is defined by the shoulder 147 and whose opposite end is closed by a seal ring 139. The location of the passages 150 is such that the upper inner seal 139 of the sleeve 55' normally is below them, blocking flow of pressurized air from the pressurized groove 146 through the play 134 to these passages 150. On the other hand the passages 148 ensure that the full pressure in the space 146 is applied in the chamber 138 against the shoulder 147.

This shoulder 147 has a relatively small effective surface area Fc and the lower end of the sleeve 55' has a substantially larger surface area Fb. Under normal circumstances, that is when the tool is coupled to the high-pressure air hose and flow is unblocked at the tubes 62', the small amount of air that can leak through the bores 145 disperses to the atmosphere and does not allow pressure to build up against the area Fb to shift the sleeve 55', in particular as the full pressure of the system is working oppositely against the albeit smaller surface area Fc.

Depression of either of the valve tubes 62' will block the turns of the spring 130 together and close the above-detailed flow path including the passages 145. Thus pressure will build up in the play 134 until it is the same on both areas Fc and Fb, whereupon the difference in size will slide the sleeve up. This action will move the seal 136 above the ports 150 and will allow the high pressure in the play 135 to flow into the motor 36–39 and drive it in a direction to screw the tip 7 into a nut, the screwing rotation being continued as long as one or both of the valve tubes 62' is depressed. Such actuation is extremely easy and comfortable, being executed with the pointing finger of either hand, typically the same finger that actuates the pushbutton 119'.

Obviously, as soon as the tube 62' is released, the pressure in the play 134 drops and the sleeve 55' reassumes the position of FIG. 5. The operation of this arrangement is otherwise the same as that of FIGS. 1 through 4.

The system according to the instant invention uses the same body of compressed air to upset the nut and then to unscrew the tip from it, rather than wasting this compressed air or using more air for such unscrewing. The unscrewing is automatic and takes place at the end of the actuation, just before the machine is again ready to receive a new rivet nut and be used again. No extra steps need be taken by the operator for such an operation.

I claim:

1. A tool for setting blind rivet nuts, the tool comprising:

a housing having a head defining a head axis;

a pulling rod extending along and rotatable about the head axis, projecting axially forwardly from the head, and threadable into a blind rivet nut;

hydropneumatic actuation means including a rear air chamber and a source of air under pressure for axially displacing the rod along the axis between an extended position projecting axially relatively far from the head and a withdrawn position axially therebehind;

pneumatic motor means connected to the pulling rod for rotating same in one sense to screw it into a rivet nut and for rotating the rod in the opposite sense direction to screw it out of the nut;

manually operable valve means connected to the motor means for rotating the rod in the one sense;

automatic valve means independent of the manual valve means and connected to the rod and between the rear chamber and the motor means for feeding air from the air chamber to the motor means and thereby automatically rotating the rod in the opposite sense on displacement of the rod by the hydropneumatic actuating means from the extended to the withdrawn position, said housing forming a liquid-filled hydraulic chamber adjacent the air chamber and the head forms a liquid-filled working chamber communicating with the hydraulic chamber, the hydropneumatic actuation means including;

a working piston in the working chamber and carrying the rod, the piston being displaceable in the working chamber between a ready position juxtaposed with the tip and corresponding to the extended position of the rod and an actuated position spaced therefrom and corresponding to the withdrawn position of the rod;

an air piston displaceable in the air chamber between a front position corresponding to maximum volume of the rear air chamber and a rear position corresponding to minimum volume of same;

a hydraulic piston carried on the air piston and displaceable in the hydraulic chamber between an advanced position pressurizing the hydraulic chamber and corresponding to the front position of the air piston and a retracted position corresponding to the rear position of the air piston;

means for pressurizing the air chamber and thereby moving the air and hydraulic pistons into the respective front and advanced positions for pressurizing the working chamber and displacing the rod from the ready to the actuated position, whereby on displacement of the rod from the ready to the actuated position a rivet nut on the rod is upset, said manual valve means including a valve body normally projecting out of the housing, and said manual valve means includes a valve housing rotatable about the head axis on the head and carrying the valve body.

2. The nut-setting tool defined in claim 1 wherein the valve body projects from the head and is provided with an actuating lever.

3. The nut-setting tool defined in claim 1, wherein the housing also forms a front air chamber also defined by the air piston and of minimum volume in the front position of the air piston and of maximum volume in the rear position of same, the hydropneumatic actuation means including a four-port two-position control valve connected to both air chambers, to the atmosphere, and to the source of air under pressure, the two-position valve being movable between a position connecting the two air chambers together and a position connecting the rear air chamber to the source and the front air chamber to the atmosphere.

4. The nut-setting tool defined in claim 3 wherein the manual valve means includes a sleeve valve having one face exposed to the pressure of the source and an opposite and larger face exposed to a pressure that is either equal to or substantially lower than that of the source.

5. The nut-setting tool defined in claim 4 wherein the manual valve means includes a pilot valve manually actuatable to relieve the pressure at the larger face.

6. The nut-setting tool defined in claim 5 wherein the pilot valve has a coil spring in the housing and a button projecting from the housing and depressable thereon to block the turns of the spring, the pilot valve defining a flow path passing through the spring and interrupted when the button is depressed and the spring blocked.

7. The nut-setting tool defined in claim 3 wherein the manual valve is a three-port two-position valve connected to the source of air under pressure, to the motor means, and to the atmosphere for alternately connecting the motor means to the source or to the atmosphere.

8. The nut-setting tool defined in claim 7 wherein the manual valve means has one end face projecting from the housing and exposed to the atmosphere and another end inside the housing and exposed to the pressure of the source.

9. The nut-setting tool defined in claim 3 wherein the automatic valve means is connected via the control valve to the air chambers and opens on displacement of the working piston from the actuated to the ready positions.

10. The nut-setting tool defined in claim 1 wherein the hydropneumatic actuation means includes a pilot valve actuatable by a finger of the hand of a person holding the housing to move the rod from the withdrawn to the extended position.

11. The nut-setting tool defined in claim 10 wherein the manual valve means includes another pilot valve actuatable by the same finger of the hand of the person holding the housing to rotate the motor in the one sense.

12. The nut-setting tool defined in claim 1 wherein the pulling rod has a threaded tip forming the threaded end and threadedly secured in the rod, the apparatus further comprising coupling means engageable between the rod and the tip to prevent relative rotation of same except when the tool is connected to the source.

13. The nut-setting tool defined in claim 12 wherein the coupling means includes a noncircular-section pin axially displaceable in the rod and rotationally coupled thereto, the tip being formed with a complementary recess into which the pin is engageable.

14. A tool for setting blind rivet nuts, the tool comprising:

a housing having a head defining a head axis;

a pulling rod extending along and rotatable about the head axis, projecting axially forwardly from the head, and threadable into a blind rivet nut;

hydropneumatic actuation means including a rear air chamber and a source of air under pressure for axially displacing the rod along the axis between an extended position projecting axially relatively far from the head and a withdrawn position axially therebehind;

pneumatic motor means connected to the pulling rod for rotating same in one sense to screw it into a rivet nut and for rotating the rod in the opposite sense direction to screw it out of the nut;

manually operable valve means connected to the motor means for rotating the rod in the one sense;

automatic valve means independent of the manual valve means and connected to the rod and between the rear chamber and the motor means for feeding air from the air chamber to the motor means and thereby automatically rotating the rod in the opposite sense on displacement of the rod by the hydropneumatic actuating means from the extended to the withdrawn position, the housing forming a liquid-filled hydraulic chamber adjacent the air chamber and the head forms a liquid-filled working chamber communicating with the hydraulic chamber, the hydropneumatic actuation means including:

a working piston in the working chamber and carrying the rod, the piston being displaceable in the working chamber between a ready position juxtaposed with the tip and corresponding to the extended position of the rod and an actuated position spaced therefrom and corresponding to the withdrawn position of the rod;

an air piston displaceable in the air chamber between a front position corresponding to maximum volume of the rear air chamber and a rear position corresponding to minimum volume of same;

a hydraulic piston carried on the air piston and displaceable in the hydraulic chamber between an advanced position pressurizing the hydraulic chamber and corresponding to the front position of the air piston and a retracted position corresponding to the rear position of the air piston;

means for pressurizing the air chamber and thereby moving the air and hydraulic pistons into the respective front and advanced positions for pressurizing the working chamber and displacing the rod from the ready to the actuated position, whereby on displacement of the rod from the ready to the actuated position a rivet nut on the rod is upset, the housing also forming a front air chamber which is also defined by the air piston and is of minimum volume in the front position of the air piston and of maximum volume in the rear position of same, the hydropneumatic actuation means further including a four-port two-position control valve connected to both air chambers, to the atmosphere, and to the source of air under pressure, the two-position valve being movable between a position connecting the two air chambers together and a position connecting the rear air chamber to the source and the front air chamber to the atmosphere, said automatic valve means being connected via the control valve to the air chambers and opens on displacement of the working piston from the actuated to the ready position, and said automatic valve means includes a cutoff valve having a valve body fixed on the rod and a valve seat fixed in the housing, the automatic valve means having a flow path passing from the front air chamber between the valve body and seat and thence to the motor means, the valve body engaging the seat and blocking the flow path when the rod is generally out of the extended position, whereby only when the rod is extended and the front chamber is pressurized, can air flow along the path from the front chamber to the motor to reverse it in the other sense.

15. The nut-setting tool defined in claim 14, further comprising afterfill valve means for connecting the front air chamber to the source of air under pressure when pressure in the front chamber exceeds a predetermined superatmospheric pressure, whereby the air flow from the front chamber to the motor to unscrew the rod is augmented.

16. The nut-setting tool defined in claim 15 wherein the afterfill valve means has:

a valve body having a relatively large face exposed to the pressure in the front chamber and an opposite relatively small face exposed to the pressure of the source; and a valve seat against which the afterfill-valve body engages whenever pressure on the large face exceeds that on the small face by a predetermined factor determined by relative sizes, and from which it lifts whenever pressure on the large face drops below a predetermined level, the afterfill valve means defining a flow path passing between the respective body and seat and extending between the source and the front chamber, whereby this flow path is cut off when pressure in the front chamber is below the predetermined pressure.

17. A tool for setting blind rivet nuts, the tool comprising:

a housing having a head defining a head axis;

a pulling rod extending along and rotatable about the head axis, projecting axially forwardly from the head, and threadable into a blind rivet nut;

hydropneumatic actuation means including a rear air chamber and a source of air under pressure for axially displacing the rod along the axis between an extended position projecting axially relatively far from the head and a withdrawn position axially therebehind;

pneumatic motor means connected to the pulling rod for rotating same in one sense to screw it into a rivet nut and for rotating the rod in the opposite sense direction to screw it out of the nut;

manually operable valve means connected to the motor means for rotating the rod in the one sense;

automatic valve means independent of the manual valve means and connected to the rod and between the rear chamber and the motor means for feeding air from the air chamber to the motor means and thereby automatically rotating the rod in the opposite sense on displacement of the rod by the hydropneumatic actuating means from the extended to the withdrawn position, the pulling rod having a threaded tip forming the threaded end and threadedly secured in the rod; and coupling means engageable between the rod and the tip to prevent relative rotation of same except when the tool is connected to the source, the coupling means including a noncircular-section pin axially displaceable in the rod and rotationally coupled thereto, the tip being formed with a complementary recess into which the pin is engageable, the pin having a piston exposed to the pressure of the source when the tool is connected thereto and the coupling means includes a spring braced against the piston and urging the pin out of engagement in the recess.

* * * * *